US005581914A

United States Patent [19]

Sinykin

[11] Patent Number: 5,581,914

[45] Date of Patent: Dec. 10, 1996

[54] SNOW CUTTING TOOTH FOR ROTATING CUTTER BAR OF SKI SLOPE TILLER

[75] Inventor: William B. Sinykin, Smithfield, Utah

[73] Assignee: LMC Operating Corp., Logan, Utah

[21] Appl. No.: 560,995

[22] Filed: Nov. 21, 1995

[51] Int. Cl.[6] ..... E01H 4/00; A01B 21/02

[52] U.S. Cl. ..... 37/223; 37/222; 37/219; 299/39.8; D15/29; 172/540; 172/112; 241/292.1

[58] Field of Search ..... 37/223, 219, 220, 37/221, 222, 224, 225, 452, 196, 246, 248, 244; 299/39.8; D15/28, 29, 11; 172/713, 112, 772.5, 540; 404/121; 241/292.1, 293, DIG. 17

[56] References Cited

U.S. PATENT DOCUMENTS

| | | | |
|---|---|---|---|
| D. 338,898 | 8/1993 | Corcoran et al. | D15/28 |
| 1,403,195 | 1/1922 | Rapattoni | 404/121 X |
| 1,544,409 | 6/1925 | Johnson | 37/452 X |
| 1,719,676 | 7/1929 | Soseman | 404/121 X |
| 1,963,686 | 6/1934 | Simpson | 172/540 |
| 2,541,007 | 2/1951 | Small | 404/121 |
| 2,660,817 | 12/1953 | Thomas | 37/222 X |
| 3,173,498 | 3/1965 | Heilbrun | 172/540 |
| 3,450,013 | 6/1969 | Peterson | 37/219 X |
| 3,760,884 | 9/1973 | Webster et al. | 172/540 X |
| 3,922,106 | 11/1975 | Caron et al. | 37/452 X |
| 4,259,765 | 4/1981 | Verboom | 37/333 |
| 4,302,129 | 11/1981 | Arenz | 172/540 X |
| 4,346,764 | 8/1982 | Rossi | 172/540 X |
| 4,619,061 | 10/1986 | Swanson | 37/248 |
| 4,738,037 | 4/1988 | Haug | 37/222 |
| 4,860,465 | 8/1989 | Brandt | 37/222 X |
| 5,358,355 | 10/1994 | Brockway | 404/121 |

FOREIGN PATENT DOCUMENTS

| | | | |
|---|---|---|---|
| 1452879 | 1/1989 | U.S.S.R. | 37/224 |

*Primary Examiner*—Eric K. Nicholson
*Assistant Examiner*—Thomas A. Beach
*Attorney, Agent, or Firm*—A. Ray Osburn

[57] ABSTRACT

A snow cutting tooth design and an associated cutter assembly design incorporating such teeth, wherein the tooth is constructed with a unitary body of steel plate welded to the outside surface of a tubular cutter bar, with bevelled edges creating acute snow cutting edges, along with a central notch also having bevelled edges and providing additional cutting edges as well as additional paths for churning and chopping the snow. The teeth are angularly joined along a centerline, dividing the tooth into a leading portion and a trailing portion, the leading portion being welded perpendicular to the centerline of the cutter bar. Some of the teeth have the rearward portion angled to the left side of the tilling machine, while others are angled to the left side, so that the snow is not moved to either side of the cutter assembly.

9 Claims, 4 Drawing Sheets

SNOW CUTTING TOOTH FOR ROTATING CUTTER BAR OF SKI SLOPE TILLER

BACKGROUND OF THE INVENTION

1. Field

The field of the invention is devices for loosening and chopping the upper layer of snow in paths for skiing, and more particularly the rotating snow cutting components thereof and the outstanding snow cutting teeth mounted on such components.

2. State of the Art

The tilling of snow upon slopes for skiing has employed such devices as agricultural harrows comprising a field of downstanding spikes and agricultural cultivators comprising disks mounted upon rotating bars to cut and churn the snow. Later, other rotating bar devices carried multiplicities of radially extending spikes. Short sections of chains have been tried. The cutter bars are rotated by power supplied by a towing vehicle, passing over the snow as it tills the path. Spikes were generally sharply pointed but dull of edge and were easily bent, and were soon replaced by teeth comprising generally rectangular steel plates arranged with edges cutting into the snow. Such teeth provided greater strength to resist tangentially directed forces. Soon the leading plate edges were sharpened for greater effectiveness and lower power expenditure. Then, the flat plate teeth were fixed angularly to the cutter bar, presenting a forwardly facing surface component. This increased the snow stirring and crushing action of the teeth. However, with the angular attachment mode, the relatively thin plates became subject to side bending loads, presenting other structural problems. To at the same time preserve the cutting and stirring functions and provide substantial side bending resistance, the individual teeth were bent along centerlines thereof. The resulting bent or angled tooth was affixed so that one-half of it directly cut into the snow without angle, while the remaining half protruded into the snow.

Advantageous as were the bend angle incorporating rectangular cutting teeth, competing needs for strength and for relatively small snow piercing tips lead to the adoption of teeth that were roughly trapezoidal in side profile. The teeth each joined the cutter bar at a broad base, but narrowed substantially to the cutting tip. The trapezoidal shape was then altered to incorporate a pair of snow piercing ears at the tip, the leading one of which aggressively chopped into crusted snow. The broadened base however carried unwanted weight of steel not significantly contributing to structural strength.

The need therefore still existed for a strong snow cutting tooth for attachment to a tiller cutter bar, which has an extended base, and an efficient snow cutting tip, but does not add excess weight resulting from the use of nonfunctional structural material therein.

BRIEF SUMMARY OF THE INVENTION

With the foregoing in mind, the disadvantages and shortcomings of prior art snow tiller cutter bar teeth are eliminated or substantially alleviated in the present invention. Uniquely configured snow cutting teeth are welded outstanding from the elongate cylindrical cutter bar. Each tooth is preferably of unitary construction, comprising a portion of a steel plate of constant thickness. As cut from the plate, preferably by flame techniques, the tooth comprises opposite faces each symmetrical about an associated face centerline.

The two faces are, however, offset with respect to each other, since the flame is at all times in all cutting positions held in associated instantaneous planes all of which are perpendicular to the stock plate and to the face centerlines. The cutting flame is also maintained at an unvarying angle to the plate. That is, the opposite faces of the tooth as cut from the plate are connected by bevelled planar leading and trailing edges the full thickness of the plate. The outermost tip ends are not bevelled in this cutting process, but are severed perpendicularly to the plate. The base edge is cut in an arc to approximately conform to the surface of the cutter bar. It is also bevelled, and attaching welds are relied upon to bridge over any imperfections in fit. A center notch is cut opening to the base of the tooth. Removal of the notch material creates a tooth shape having a pair of legs to be welded widely spaced apart at the cutter bar. The legs converge outwardly from the bar and join to form a relatively narrow snow chopping tip. The tip itself is configured with forwardly and rearwardly extending ear portions for effectively cutting crusted snow.

The flat planar tooth cut from the plate is, before welding to the cutter bar, sharply bent in a stamping machine along a line which generally coincides with a centerline of one of the tooth faces. This divides the tooth into a forward and a rearward planar portion, each comprising approximately one-half of the tooth, angled a few degrees with respect to each other. The two legs of the bent tooth are welded to the surface of the tubular cutter bar with the plane of the forward portion perpendicular to the centerline of the bar, with the rearward portion then protruding into the path of a stream of snow being tilled. The trailing portions of the teeth thoroughly mix and churn the snow. The rearward portion of the tooth is preferably angled in a direction toward the side of the tooth opposite the side having the leading cutting edge formed by the bevel cut.

A multiplicity of the individual teeth are preferably affixed in at least two parallel helical patterns about and along the cutter bar. Successive helical rows of teeth are preferably oppositely bent and edge bevelled. The angled trailing portions of the teeth of neighboring rows protrude toward each other, urging snow in opposite directions, and counteracting any tendency for snow to be urged toward either end of the cutter bar.

Snow impelled longitudinally to the cutter bar by the protruding trailing portions tends to flow in part through the central notches of the teeth. Then, the forwardly directed sharp edges of the notches further cut the snow passing through.

It is therefore the principal object for the invention to provide an improved cutter bar tooth for ski slope snow tilling machines, which is of decreased weight but is unimpaired in structural strength and which is more efficient in cutting and pulverizing the snow.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
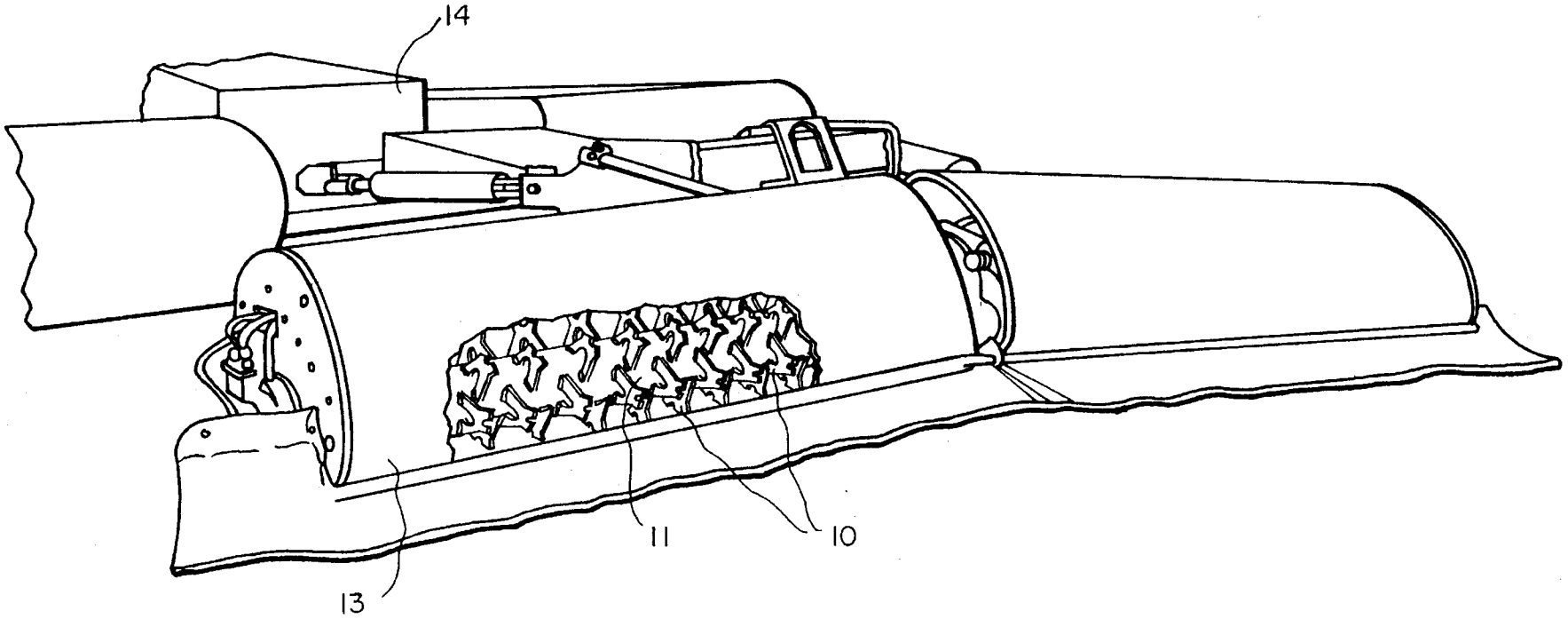
FIG. 1 is a perspective view of a snow tiller assembly, being cut away to indicate a cutter bar assembly with outstanding teeth incorporated thereinto, drawn to a reduced scale, FIG. 2 a cross sectional view of a fragment of the cutter bar of FIG. 1 showing one of the teeth thereof in profile, drawn to substantially full scale, FIG. 3 a plan view of the fragment of FIG. 2, taken along line 3—3 thereof, drawn to the same scale, FIG. 4 a drawing of a fragment of the cutter bar of FIG. 1 showing an individual snow cutting tooth in each of three patterns upon the cutter bar, the teeth being represented as horizontal sectional views thereof taken along line 6—6 of FIG. 2, drawn to substantially full scale, FIG. 5 a plan view of the fragment of FIG. 2, the tooth thereof however being bent in a direction placing the cutting edge of the notch outside the plane of the forward portion of the tooth, the tooth being represented as a cross section taken along line 6—6 of FIG. 2, drawn to substantially full scale, and FIG. 6 a perspective view of a fragment of the cutter bar of FIG. 1 indicating the teeth attached to the cutter bar in parallel helical patterns, drawn to a reduced scale.

A multiplicity of the inventive cutter teeth 10 are secured outstanding from a tubular cutter bar 11, as by welds 12. (FIG. 1 and 2) Cutter bar 11 has means, not shown, for incorporation into a tiller assembly 13, through which rotary power is provided. The multiplicity of teeth 10 crush and powderize the snow of a path to condition it for skiing. Tiller 13 is drawn through a towing device 14 by a tracked vehicle, not shown. Teeth 10 are spaced apart longitudinally and circumferentially upon bar 11, preferably along one or more pairs of parallel, bar encircling, helical paths from end to end.

Each tooth 10 is preferably constructed by flame cutting from steel plate stock 15, which is preferably ⅜ to ½ inches in thickness to provide the sturdiness required not only to crush the snow but to also withstand impact with rocks and other solid foreign objects. (FIG. 2) Tip speeds of the tooth 10 reach several hundred inches per second, so that the impact is often very considerable. Accordingly, the tooth 10 also has a very broad base secured by welds 12 to the outside surface of cutter bar 11 in the general circumferential direction thereof. However, for impact resistance in this direction, much of the material of plate 15 near the geometric center of tooth 10 tends to be very inefficiently utilized. It is therefore possible to cut away much of this central portion with negligible effect upon tooth strength. This provides a central opening or notch 16 through tooth 10. Besides conserving material and weight, the central opening 16, as later discussed, adds considerably to the effectiveness of tooth 10 for snow crushing, mixing and powderizing.

Figure 2:
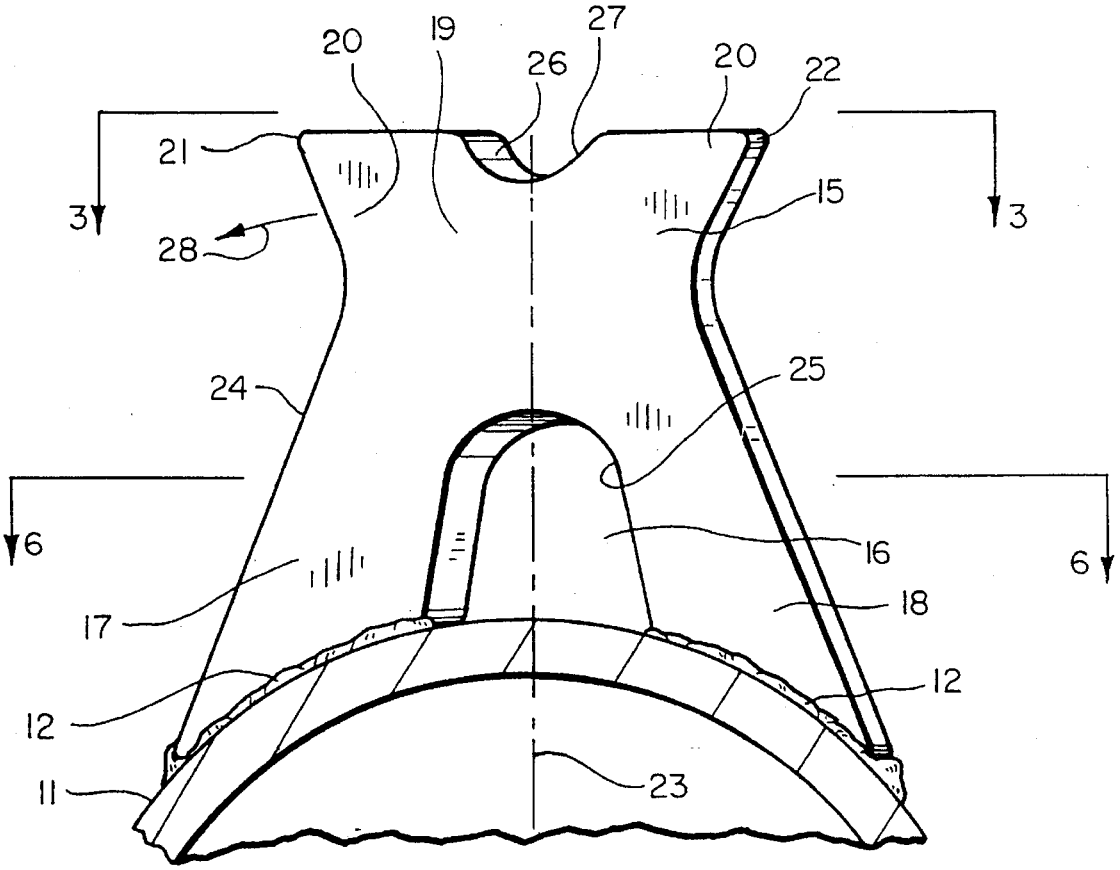

Removal of the center portion 16 leaves widely spaced leading and trailing legs 17 and 18 respectively, which converge toward and join a tip structure 19. Each side of tip structure 19 has a circumferentially flaring portion 20 comprising acutely angled leading and trailing snow piercing tip ends 21 and 22, respectively, the former of which effectively breaks up heavily crusted or icy snow as cutter bar 11 rotates. (FIG. 2)

Figure 3:
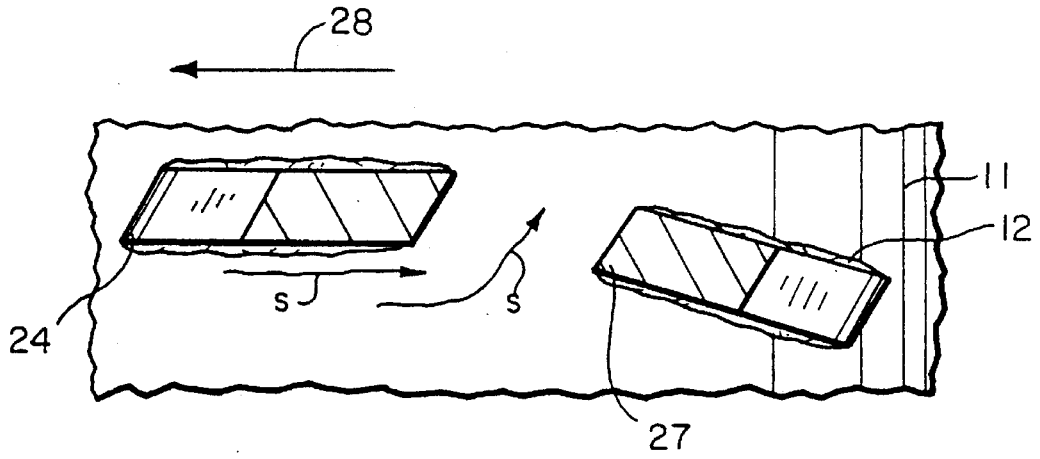

The bending resistance of tooth 10 in the perpendicular direction to plate 15 (longitudinally to cutter bar 11) is inherently much less than in the parallel direction (lateral to the cutter bar). To provide needed tooth sidewise stiffness, each tooth is bent approximately 15° along a centerline 23 radially to the bar. The planes of the two legs 17 and 18 with attached tip structures intersect approximately at centerline 23. (FIG. 3) As subsequently discussed, the angled portions and the central notch openings 16 combine to produce more efficient and thorough crushing and breakup of the snow.

Tooth 10 is preferably flame cut from the flat plate stock 15. In this process, the flame may be stationary and the plate 15 translated to cut the tooth pattern from the plate. Alternately, the plate may be held stationary and the cutting flame moved to trace the desired tooth pattern and cut it from the plate. All tooth edges, leading, trailing, notch, base and tip, are cut with flame at an angle of about 60° to plate 15. During cutting, the flame is at all times directed to be within a plane which is perpendicular to both the plate and the axis of symmetry 23 of the tooth face pattern being cut. The radially outermost tip portion 19 is not bevelled by this process, but is cut to be entirely within a plane perpendicular to the stock plate 15, except for a small tip notch 26 which also has bevelled leading and trailing edges.

This process of manufacture provides the leading cutting edge 24 and also additional forward facing cutting edges 25 and 27, the latter carried by the small notch 26 in tip structure 19. The additional forward facing cutting edge 25 the length of notch 16 is achieved with very little sacrifice of bending resistance circumferentially to bar 11.

Subsequent to flame cutting, tooth 10 is bent, preferably in a cold stamping press, to the aforementioned angle of about 15°, and then welded with the plane of the leading leg 17 perpendicular to the longitudinal centerline of cutter bar 11. The trailing leg 18 portion is angled outwardly into the snow. (FIG. 3) The openings 29 of notch 16 through the center of each of the teeth 10 constitute paths through which the snow is forced, increasing the crushing and mulching.

The protruding surface of the trailing edge 18 tends to impel the snow longitudinally along cutter bar 11. However, opposing teeth **10*n* disposed in a neighboring parallel helical row 38 (FIG. 6) are configured to counteract this tendency, so that snow is not moved toward one end or the other of cutter bar 11. (FIG. 4, snow arrows s) The small tip notch 27 contributes an additional, if small, length of cutting edge 27. A side view of tooth 10 taken longitudinally to cutter bar 11 is seen in FIG. 2, showing leading cutting edge 24, notch cutting edge 25 and tip notch cutting edge 27. Arrows 28 indicate direction of motion during operation of tiller 13. The sizeable central opening 29 provided by notch 16 is clearly indicated, as is bend line 23**.

Tooth 10 is attached with plane 30 of leading portion 31 perpendicular to cutter bar 11, with plane 32 of trailing portion 35 skewed by angle 34 (approximately 15°) in a direction seemingly causing notch cutting edge 25 to be shielded from the flow of snow past the tooth. (FIG. 4) In reality, notch cutting edge 25 is well positioned to operate upon snow being urged through notch opening 29 by action of neighboring teeth, such as tooth **10*n*. Tooth 10*n* is preferably configured to be a mirror image of tooth 10. The cutting edges of teeth 10 and 10*n* are on opposite sides of plate 15, and the directions of skew angles 34 and 34*n* are opposite. Arrows s indicate snow being thrown toward tooth 10 by one of the teeth 10*n*. Tooth 10 urges snow toward tooth 10*n*. The resulting turbulent snow flow causes snow to be urged through notch openings 29, to be then further chopped by notch cutting edges 25 and 25*n***.

Figure 5:
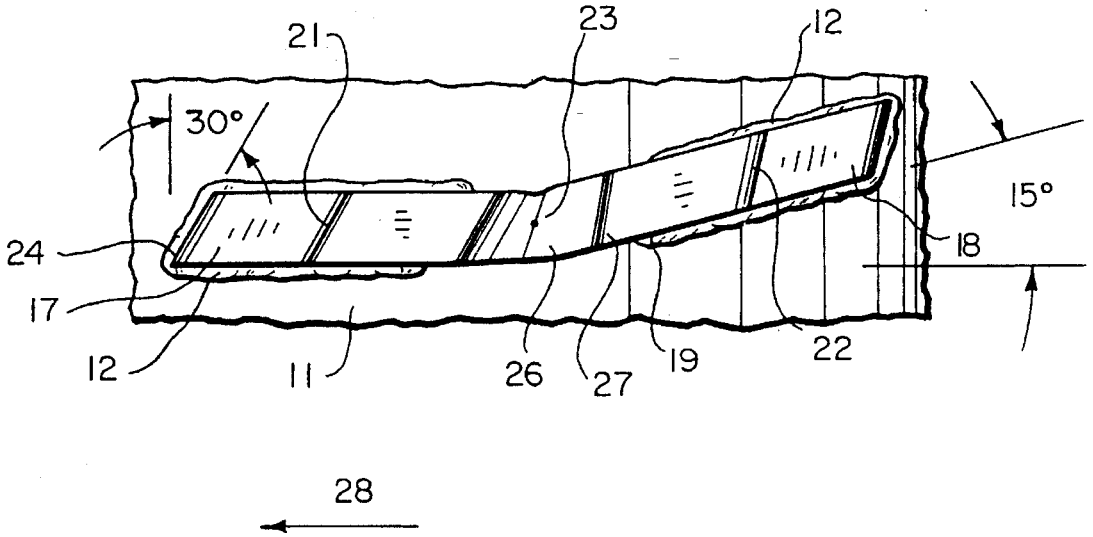
Figure 6:
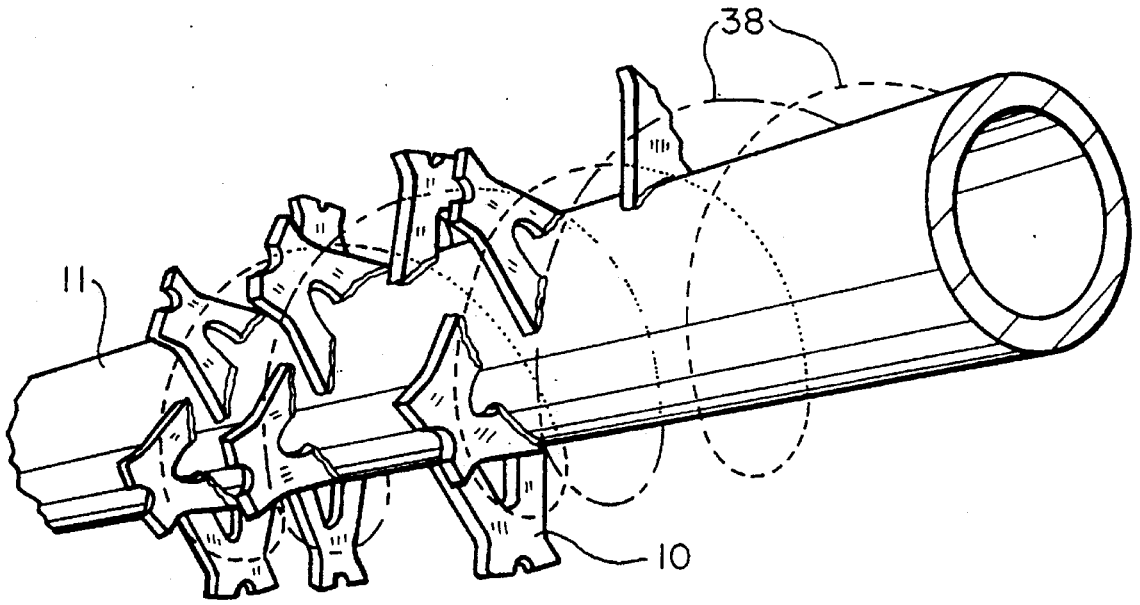
Figure 4:
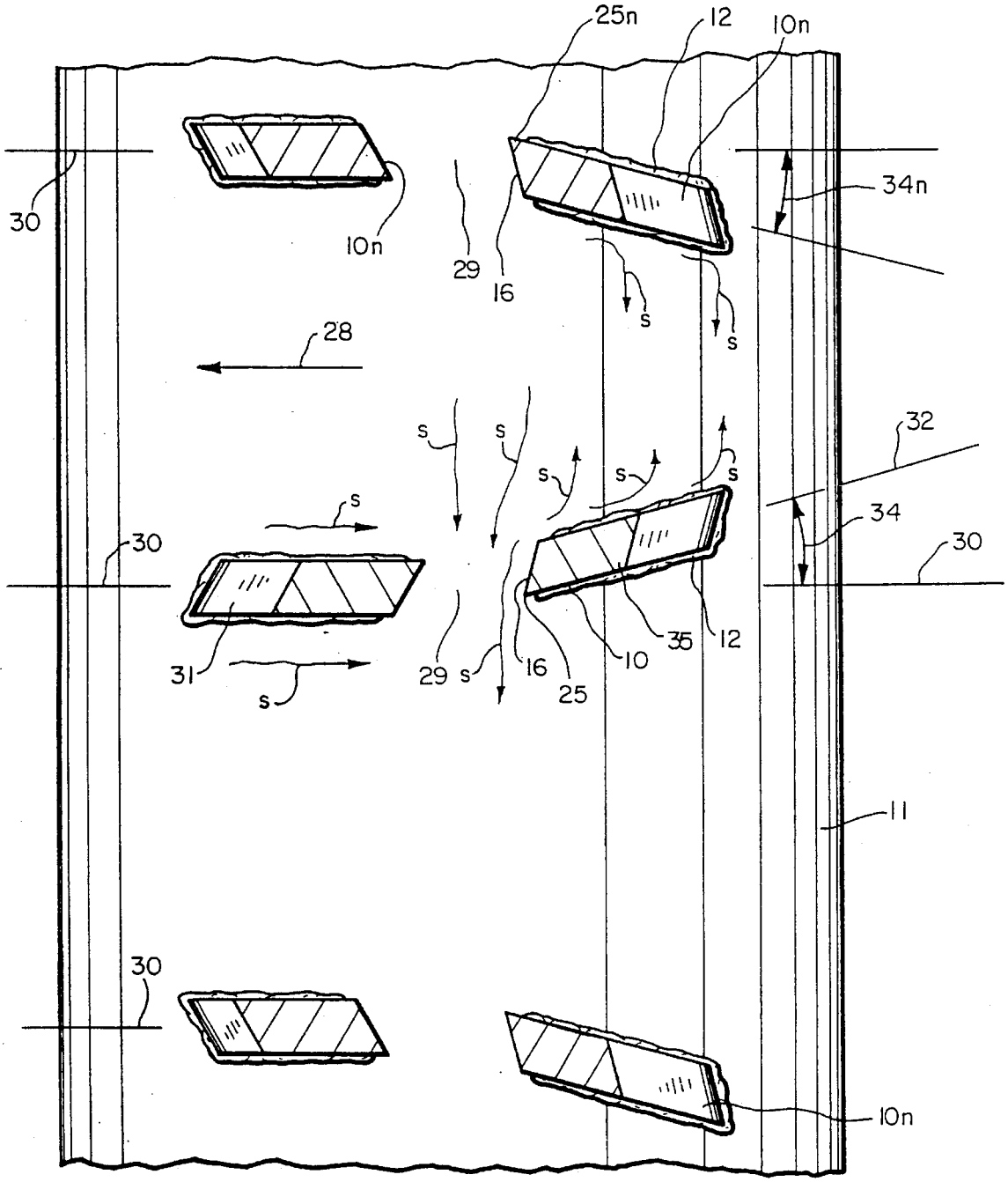

The indicated alignment of teeth in rows longitudinal to cutter bar 11 in FIGS. 4 and 6 is by way of example only. The teeth of neighboring rows are often also circumferentially displaced. However, the snow cutting and impelling action described above is believed to characterize the action of the teeth upon the snow in both instances. Teeth 10 with skew angles 34 of opposite direction would also effectively chop and churn the snow, with notch cutting edge 25 placed directly in the flow of snow past the tooth. (FIG. 5)

The above description of the action of teeth 10 and 10*n*, individually and interactively, is qualitative, even conjectural. The provision of additional cutting edge by the notch is however certain, and tooth 10 has been shown to in fact more efficiently and evenly pulverize and crush the snow.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description, and all changes that come within the meaning and range of equivalency of the claims are, therefore, intended to be embraced therein.

What is claimed and desired to be secured by United States Letters Patent is:

1. A snow cutting tooth for attachment radially outstanding from an elongate cylindrical tubular bar which is mounted laterally to and rotatably upon a frame of a snow tiller assembly, having a right hand and a left hand side, said tooth comprising:

a unitary body of metallic plate, having a base edge curved to conform approximately to the outside of the tubular bar circumferentially thereto, and secured thereto by welding, said body comprising planar leading and trailing portions respectively extending in and opposite to the direction of motion of the tooth resulting from rotation of the bar, said portions each comprising approximately one half of the body, and being joined angularly along a line radial to said bar, the leading and trailing portions having a forwardly and a rearwardly facing edge respectively;

wherein the forwardly facing edge of the leading portion comprises an acute snow cutting edge formed by a bevel extending across the full thickness of the plate at an angle thereto;

the rearwardly facing edge of the trailing portion comprises an acute edge formed by a bevel extending across the full thickness of the plate at said angle thereto, the body further comprising;

a notch the full thickness of the plate, opening through the base edge thereof generally symmetrically about said line of joinder of the leading and trailing body portions, said notch having a continuous edge with a forward segment thereof disposed in the leading body portion and the remaining, rearward segment in the trailing body portion, the edges of said forward and rearward segments being respectively bevelled across the full thickness of the plate in directions parallel to the bevels of the forwardly and rearwardly facing edges of the plate; said rearward segment having a forwardly facing acute edge and said forward segment having a rearwardly facing acute edge.

2. The snow cutting tooth of claim 1, wherein:

the body portions are joined at an angle such that the forwardly facing acute edge of the rearward notch segment is disposed directly rearwardly of the plate of the leading body portion.

3. The snow cutting tooth of claim 1, wherein:

the body portions are joined at an angle such that the forwardly facing acute edge of the rearward notch segment is disposed outwardly of the plate of the leading body portion on the side thereof carrying the forwardly facing acute snow cutting edge.

4. The snow cutting tooth of claim 2, wherein:

the body portions are joined at an angle such that the rearward one thereof extends toward the right hand side of the tiller assembly.

5. The snow cutting tooth of claim 2, wherein the body portions are joined at an angle such that the rearward one thereof extends toward the left hand side of the tiller assembly.

6. A snow tiller assembly having at least one snow cutter assembly comprising an elongate tubular bar with a multiplicity of snow cutting teeth outstanding radially therefrom, at least a portion of said multiplicity of teeth each comprising:

a unitary body of metallic plate, having a base edge curved to conform approximately to the outside of the tubular bar circumferentially thereto, and secured thereto by welding, said body comprising planar leading and trailing portions respectively extending in and opposite to the direction of motion of the tooth resulting from rotation of the bar, said portions each comprising approximately one half of the body, and being joined angularly along a line radial to said bar, the leading and trailing portions having a forwardly and a rearwardly facing edge respectively;

wherein the forwardly facing edge of the leading portion comprises an acute snow cutting edge formed by a bevel extending across the full thickness of the plate at an angle thereto;

the rearwardly facing edge of the trailing portion comprises an acute edge formed by a bevel extending across the full thickness of the plate at said angle thereto, the body further comprising;

a notch the full thickness of the plate, opening through the base edge thereof generally symmetrically about said line of joinder of the leading and trailing body portions, said notch having a continuous edge with a forward segment thereof disposed in the leading body portion and the remaining, rearward segment in the trailing body portion, the edges of said forward and rearward segments being respectively bevelled across the full thickness of the plate in directions parallel to the bevels of the forwardly and rearwardly facing edges of the plate; said rearward segment having a forwardly facing acute edge and said forward segment having a rearwardly facing acute edge.

7. The snow tiller assembly of claim 6, wherein:

the body portions are joined at an angle such that the forwardly facing acute edge of the rearward notch segment is disposed directly rearwardly of the plate of the leading body portion.

8. The snow tiller assembly of claim 6, wherein:

the body portions are joined at an angle such that the forwardly facing acute edge of the rearward notch segment is disposed outwardly of the plate of the leading body portion on the side thereof carrying the forwardly facing acute snow cutting edge.

9. The snow tiller assembly of claim 7, wherein:

the multiplicity of teeth are disposed about and along the cutter bar in at least one pair of parallel helical paths, at least a portion of the teeth in one of said paths being configured with the trailing body portions thereof angled oppositely to the trailing body portions of at least a portion of the teeth in the other of the pair of helical paths.

* * * * *